US008986600B2

(12) United States Patent
Nallen et al.

(10) Patent No.: US 8,986,600 B2
(45) Date of Patent: Mar. 24, 2015

(54) SPRAY QUENCH SYSTEMS FOR HEAT TREATED METAL PRODUCTS

(71) Applicant: Thermatool Corp., East Haven, CT (US)

(72) Inventors: Michael A. Nallen, Hampden, MA (US); Paul F. Scott, Farmington, CT (US)

(73) Assignee: Thermatool Corp., East Haven, CT (US)

( * ) Notice: Subject to any disclaimer, the term of this patent is extended or adjusted under 35 U.S.C. 154(b) by 97 days.

(21) Appl. No.: 13/958,581

(22) Filed: Aug. 4, 2013

(65) Prior Publication Data

US 2013/0312879 A1 Nov. 28, 2013

Related U.S. Application Data

(63) Continuation-in-part of application No. 11/672,544, filed on Feb. 8, 2007, now Pat. No. 8,501,083.

(60) Provisional application No. 60/771,386, filed on Feb. 8, 2006.

(51) Int. Cl.

| | |
|---|---|
| ***C21D 1/00*** | (2006.01) |
| ***C21D 9/00*** | (2006.01) |
| ***C21D 6/00*** | (2006.01) |
| ***C21D 1/667*** | (2006.01) |
| ***C21D 1/18*** | (2006.01) |
| ***C21D 9/08*** | (2006.01) |
| ***C21D 1/62*** | (2006.01) |

(52) U.S. Cl.

CPC *C21D 1/667* (2013.01); *C21D 1/18* (2013.01); *C21D 9/08* (2013.01); *C21D 9/085* (2013.01); *C21D 1/62* (2013.01)

USPC ..... 266/114

(58) Field of Classification Search

None

See application file for complete search history.

(56) References Cited

U.S. PATENT DOCUMENTS 6,656,413 B2 * 12/2003 Kay ..... 266/46

* cited by examiner

*Primary Examiner* — Sarah A Slifka

(74) *Attorney, Agent, or Firm* — Philip O. Post

(57) ABSTRACT

A spray quench system is provided with one or more spray quench rings that eject a controlled volume of quenchant spray onto a workpiece passing through the quench rings. Supply of the quenchant to the quench rings is coordinated with control of the quench rings to selectively change the pressure, quenchant spray exit velocity from the quench rings, flow rate or pattern of the quenchant spray onto the workpiece depending upon mass cooling requirements as the workpiece passes through the quench rings.

21 Claims, 16 Drawing Sheets

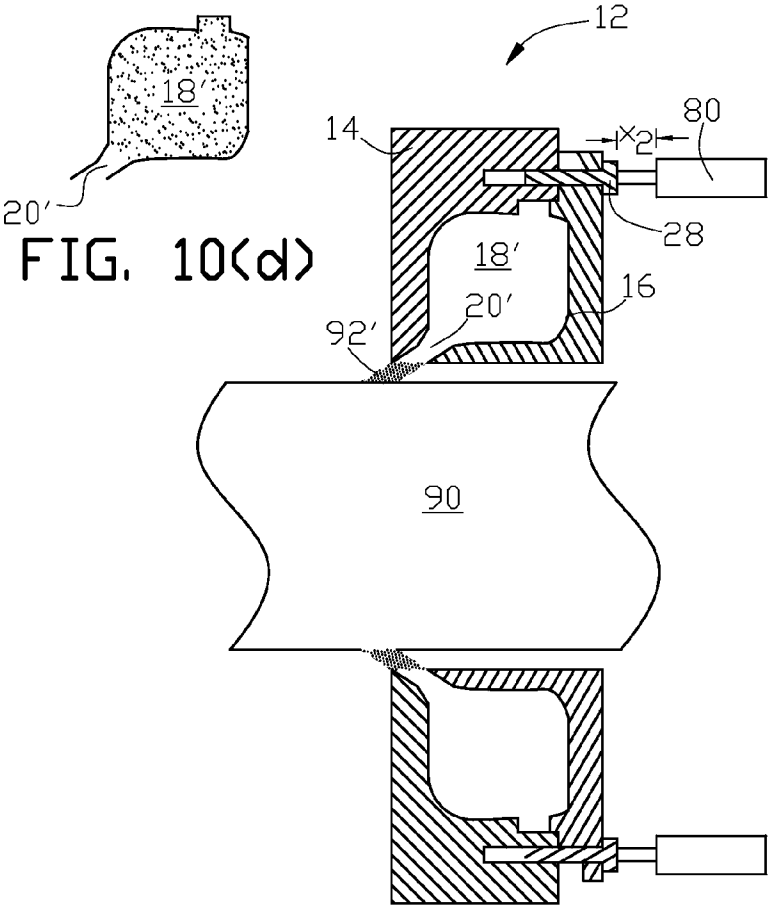
FIG. 10(d)
FIG. 10(b)
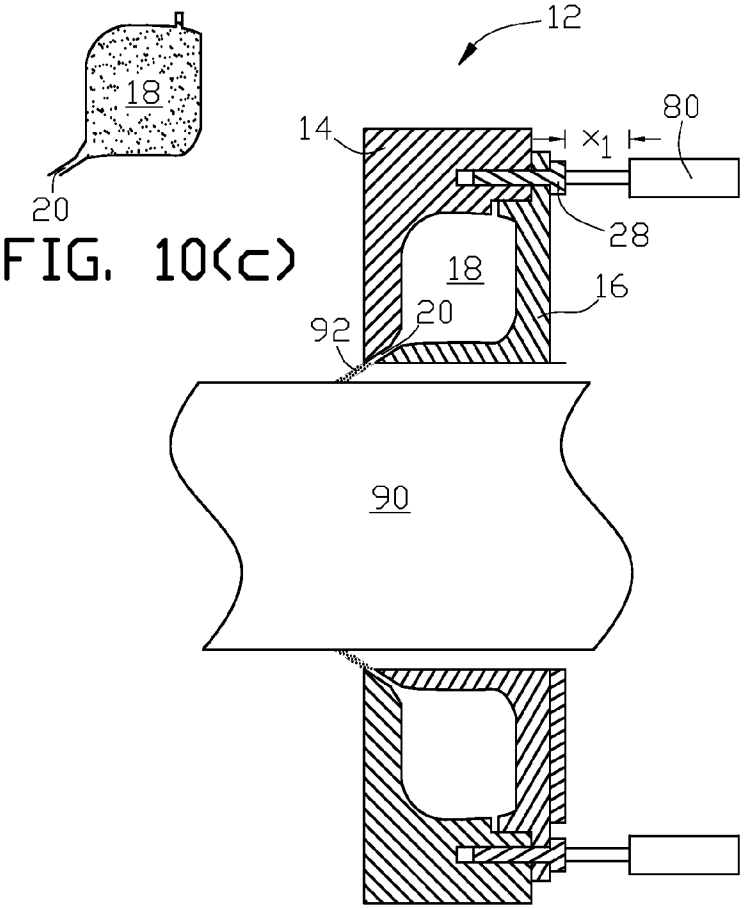
FIG. 10(c)
FIG. 10(a)

SPRAY QUENCH SYSTEMS FOR HEAT TREATED METAL PRODUCTS

CROSS REFERENCE TO RELATED APPLICATIONS

This is a continuation-in-part application of application Ser. No. 11/672,544, filed Feb. 8, 2007, which application claims the benefit of U.S. Provisional Application No. 60/771,386, filed Feb. 8, 2006, both of which applications are hereby incorporated herein by reference in their entireties.

FIELD OF THE INVENTION

The present invention relates to spray quench systems used in heat treatment processes of metal products.

BACKGROUND OF THE INVENTION

Quench, or quench and temper, metallurgical processes are widely used to harden, or harden and temper, a manufactured metal product such as steel pipe, to achieve desired metallurgical and mechanical properties different from those of the starting material used to produce the metal product. Quenching is done after heating of the product, for example, by electric induction heating. Open spray quenching systems are one type of quench systems that can be used to accomplish the hardening and tempering of the metal product. When in-line quenching round, square, rectangular or other shaped products, such as pipes, bars or tubing, at production line speed, an important parameter that determines the material properties achieved by these processes is the metal cooling rate, which must generally be as fast as is possible to obtain the desired results. The cooling rate is determined, in part, by the volume of quenchant used during the rapid cooling of a heated metal part and the velocity of quenchant at the metal surface. The traditional apparatus used to provide a high volume flow of water to the surface of a heated part is sometimes known as a quench barrel. The typical quench barrel is a large diameter, monolithic cylinder equipped with a multitude of holes or nozzles through which quench media flows under medium pressure. Upon contact with the heated metal part, the quenchant provides the rapid cooling necessary to obtain a desired hardness. Also well known is the fixed position quench ring or slot quench. This apparatus is a hollow ring through which the part to be quenched passes. The apparatus contains a multitude of equally spaced holes or slots that act as nozzles for the quenching fluid. The slot quench is typically used in single part, small volume applications, such as induction hardening scanners.

There also exists spray quench apparatus, such as U.S. Pat. No. 2,657,698 where a spray outlet passage is formed between inner surface (34) of radial flange (15) and inner surfaces (31) and (32) of insert (17) and annular casting (27), respectively, as shown in FIG. 2 of U.S. Pat. No. 2,657,698. Flange (15) terminates in a sharp edge 16 that extends in a generally axial direction corresponding to the direction of the workpiece travel. Annular casting (27) also extends in the axial direction corresponding to the direction of workpiece travel and terminates in edge (33).

Quenching systems must be capable of treating a range of product diameters. However, existing quench barrels and quench rings have a fixed inside diameter. When products having different diameters pass through these fixed diameter devices, the shape of the spray impinging on the product, the spray flow rate, and spray pressure change due to the difference in gap between the spray nozzles and the product. For existing quench systems when the spray is reflected from the product for a given nozzle, the reflected spray can interfere with the spray pattern of adjacent nozzles, and diminish or even destroy their effectiveness. The above limitations of existing quench systems can also cause expanding steam to form at the surface of the product to be quenched. This creates a thermal steam barrier that greatly reduces the rate of cooling of the product.

Further the small "pin hole" quench nozzles used to create the water jets in existing barrel quench systems limit the effective spray volumes and pressures that can be achieved.

Additionally since the product typically must move through the quench device both linearly and while rotating, the supporting conveyor rolls are skewed relative to the axis of travel of the product. This causes different diameter product to run on different centerlines through the conventional fixed geometry quench systems.

It is an object of the present invention to overcome the above limitations of existing spray quench systems.

It is another object of the present invention to provide a spray quench system where the quench rings in the spray quench system are coordinated with the type of quenchant supply to the quench rings to change the pressure, quench ring exit velocity, flow rate, and/or pattern of the spray quench from the outlets of the quench rings in the spray quench system.

Other objects of the present invention are illustrated by the aspects of the invention set forth in this specification and the appended claims.

BRIEF SUMMARY OF THE INVENTION

In one aspect the present invention is a spray quench system for quenching a metal product or workpiece. A quenchant is supplied to one or more quench rings. Each quench ring has an outer and inner ring element. The outer ring element has at least one exterior opening for connection to a supply of quenchant to an interior region of the outer ring element. An inner ring element is at least partially inserted into the outer ring element, and a quench ring plenum for receiving the supply of quenchant from the at least one exterior opening is formed from the interior region of the outer ring element in combination with an interior region of the inner ring element. An outlet passage from the quench ring plenum is formed between adjacent facing edges of the outer ring element and the inner ring element for receiving the quenchant from the quench ring plenum and ejecting the quenchant received from the quench ring plenum in a conical volume to make contact with a surface region of the workpiece. One or more fasteners join the inner ring element and the outer ring element. The supply of quenchant to each quench ring can be from a fixed or variable flow rate source, including a high pressure pump. A fastener control apparatus is provided in some examples of the invention to adjust the fasteners to change the volume of the outlet passage of one or more of the quench rings during the quench process.

In another aspect the present invention is a method of quenching a metal product or workpiece with a spray quench system. The workpiece passes through a quench ring assembly that comprises one or more quench rings. Each quench ring has an outer ring element at least partially inserted into an inner ring element with the outer ring element and the inner ring element joined together by one or more fasteners. The outer ring element has at least one exterior opening to an interior region of the outer ring element. A quench ring plenum is formed from the interior region of the outer ring element in combination with an interior region of the inner ring element for receiving a quenchant from the at least one exterior opening, and an outlet passage from the quench ring plenum is formed between adjacent facing edges of the outer ring element and the inner ring element for receiving the quenchant from the quench ring plenum and ejecting the quenchant received from the quench ring plenum in a conical volume to make contact with a surface region of the workpiece.

In another aspect the present invention is a method of executing a spray quench control software program by a computer processor to coordinate the quenchant ejected from each of the at least two quench rings with the mass cooling requirement of the workpiece as the workpiece passes through the spray quench system by selectively or in combination: (1) adjusting an in-line distance between at least two of the at least two quench rings quench; (2) adjusting the central axis of at least one of the at least two quench rings; (3) adjusting the position of at least one spray guard associated with at least one of the at least two quench rings; (4) adjusting the outlet shape and volume of the outlet passage of at least one of the at least two quench rings; and (5) adjusting the flow rate and quenchant volume for at least one of the at least two quench rings. The temperature of the workpiece can be sensed as the workpiece passes through the spray quench system to further coordinate the quenchant ejected from each of the at least two quench rings with the mass cooling requirement of the workpiece as the workpiece passes through the spray quench system.

The above and other aspects of the invention are further set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

FIG. 8(*b*) is a cross sectional view of the quench ring in FIG. 7(*a*) through line A-A in FIG. 7(*a*).

FIG. 9(*b*) is an exploded cross sectional view of an outer ring element, inner ring element and fastener for a quench ring that can be used in a spray quench system of the present invention.

FIG. 9(*c*) illustrates in cross section the plenum volume and outlet passage shown in FIG. 9(*a*).

FIG. 10(*a*) and FIG. 10(*b*) illustrate one arrangement for using a fastener control apparatus to change the volume of the outlet passage of a quench ring that can be used in a spray quench system of the present invention, with corresponding detail views FIG. 10(*c*) and FIG. 10(*d*) illustrating the volume change in cross section.

FIG. 12(*b*) illustrates another arrangement for supply of a quenchant to quench rings that can be used in a spray quench system of the present invention.

FIG. 12(*c*) illustrates another arrangement for supply of a quenchant to quench rings that can be used in a spray quench system of the present invention.

DETAILED DESCRIPTION OF THE INVENTION

In all examples of the invention, workpiece 90 (metal product) being heat-treated moves linearly through one or more quench rings along the Z-axis and in the direction of the arrow shown in the figures in a spray quench system of the present invention. In some examples of the invention, the workpiece may also rotate about the Z-axis as it moves through the one or more quench rings. Suitable mechanical means, not shown in the figures, such as support rollers are used to advance the workpiece through the quench rings. Although workpiece 90 is illustrated as a cylindrical pipe or conduit, the invention may be used with workpieces of different shapes such as, but not limited to, a rectangular tube. Also the workpiece may comprise a series of discrete workpieces, such as gears, suitably mounted on a conveyance means for moving the discrete workpieces through the one or more quench rings. Heating apparatus for heating the workpiece prior to quenching is not shown in the figures, but may be, by way of example and not limitation, one or more solenoidal electric induction coils surrounding the workpiece for inductively heating the workpiece when an alternating current flows through the one or more coils. Also in some configurations, heating apparatus may be interspaced between two or more of the quench rings.

Figure 1:
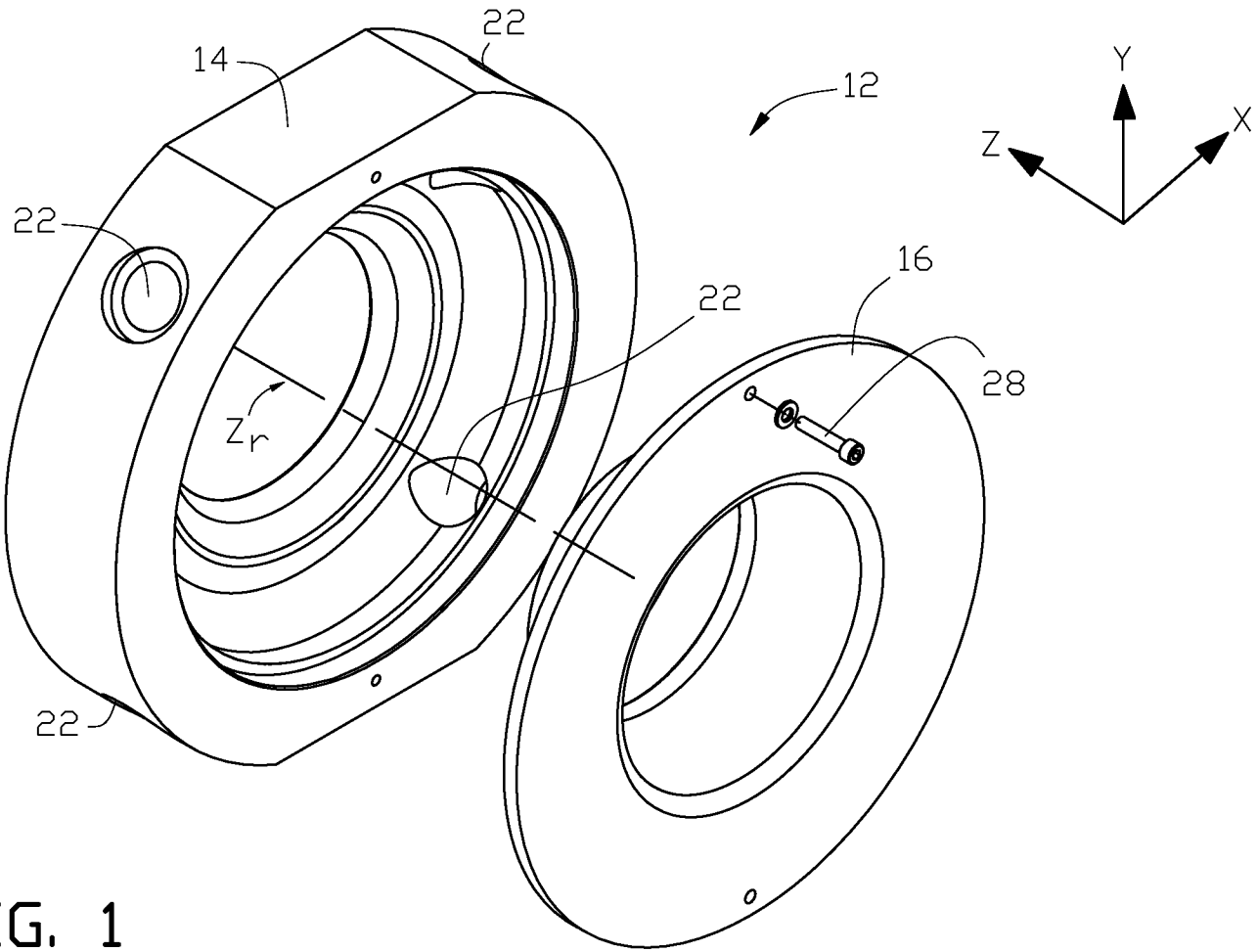
FIG. 1 is a perspective view of one example of a quench ring used in a spray quench system of the present invention.
Figure 3:
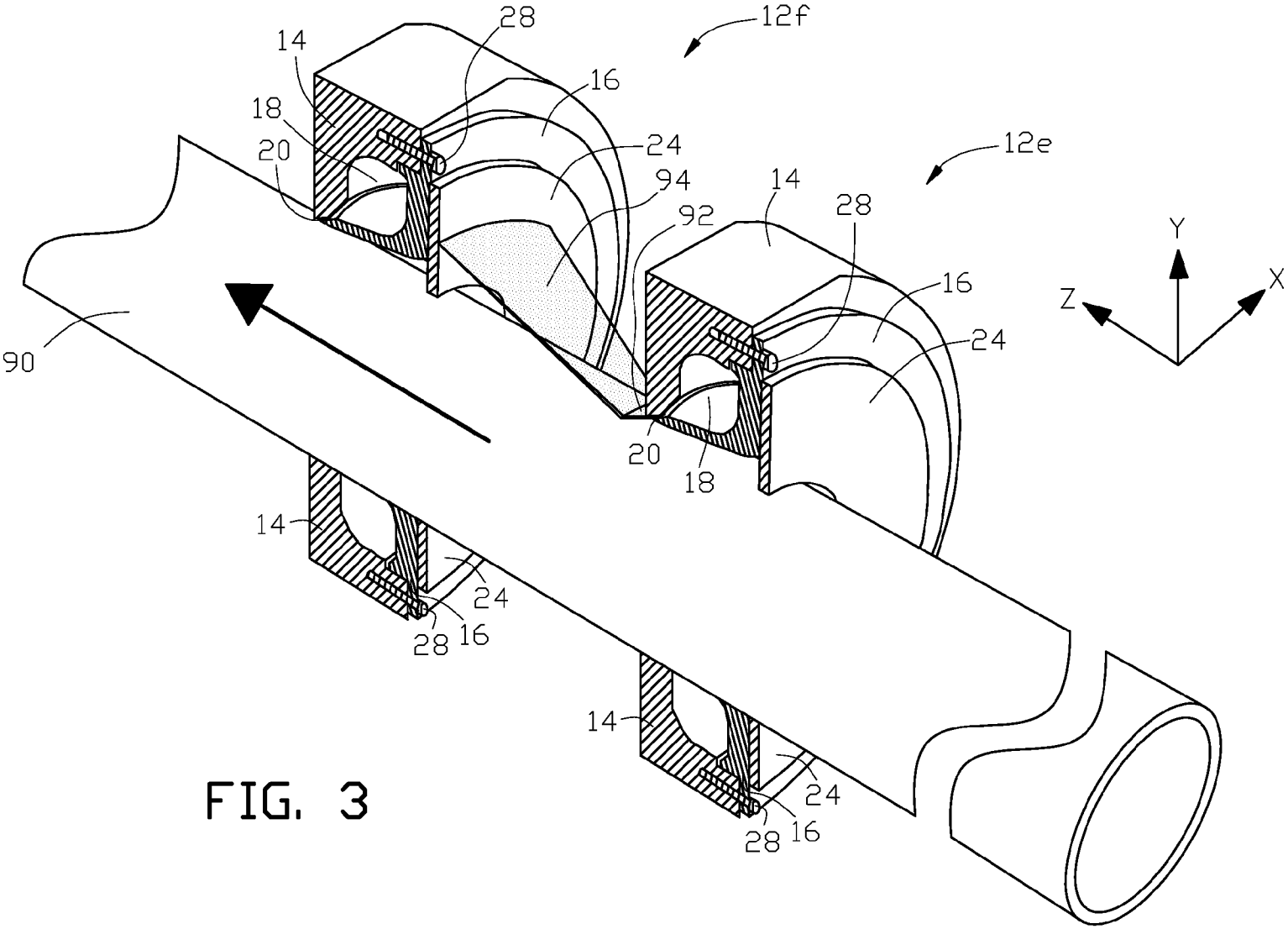
FIG. 3 is a sectional view of one example of two quench rings of a spray quench system of the present invention.
Figure 4:
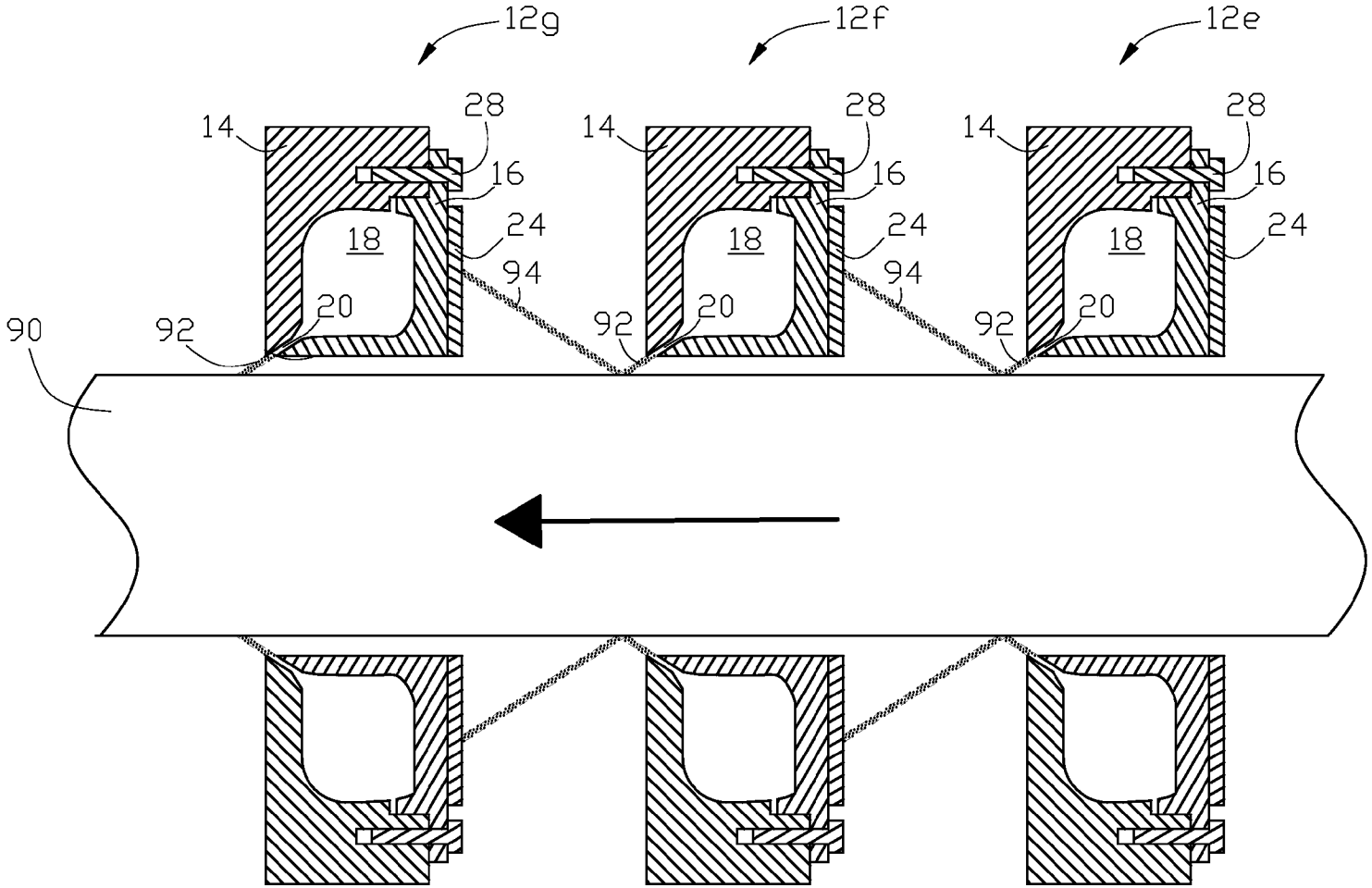
FIG. 4 is a sectional view of one example of three quench rings of a spray quench system of the present invention.
Figure 5:
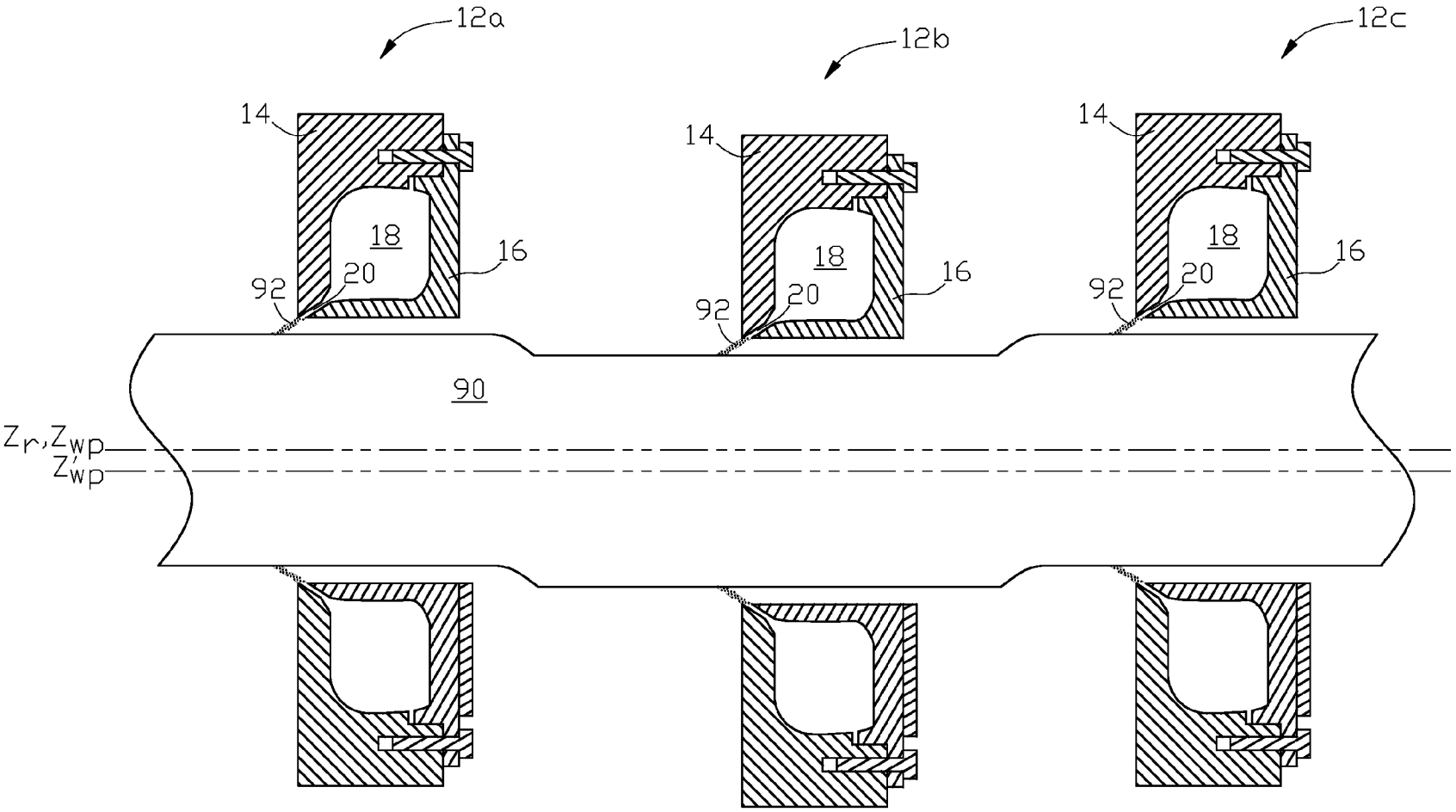
FIG. 5 illustrates deviation of the central axis of a workpiece passing through a quench ring of a spray quench system of the present invention and position adjustment of the quench ring relative to the deviation of the central axis of the workpiece.
Figure 8B:
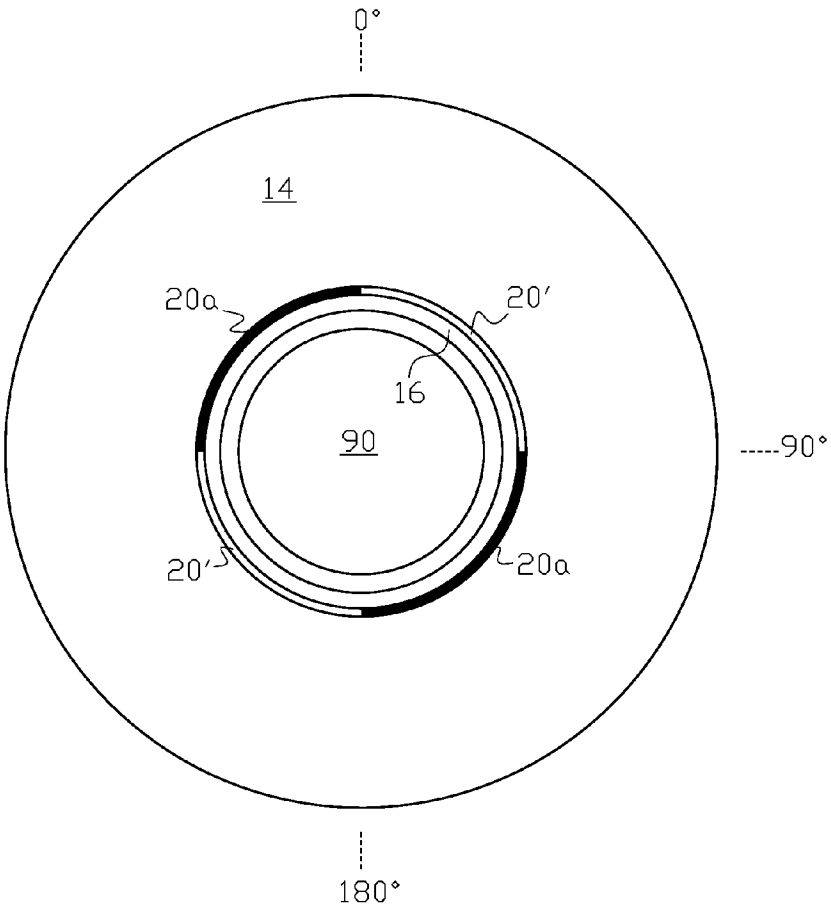
FIG. 8(*a*) is a sectional view of another example of a quench ring that can be used in a spray quench system of the present invention.
Figure 8A:
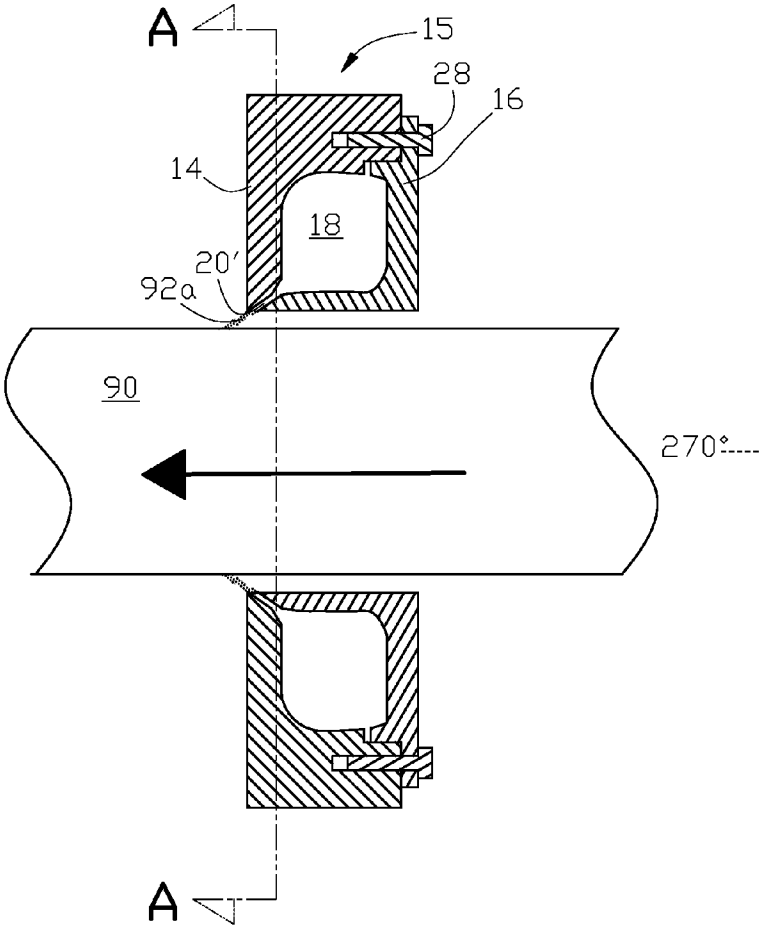
Figure 12A:
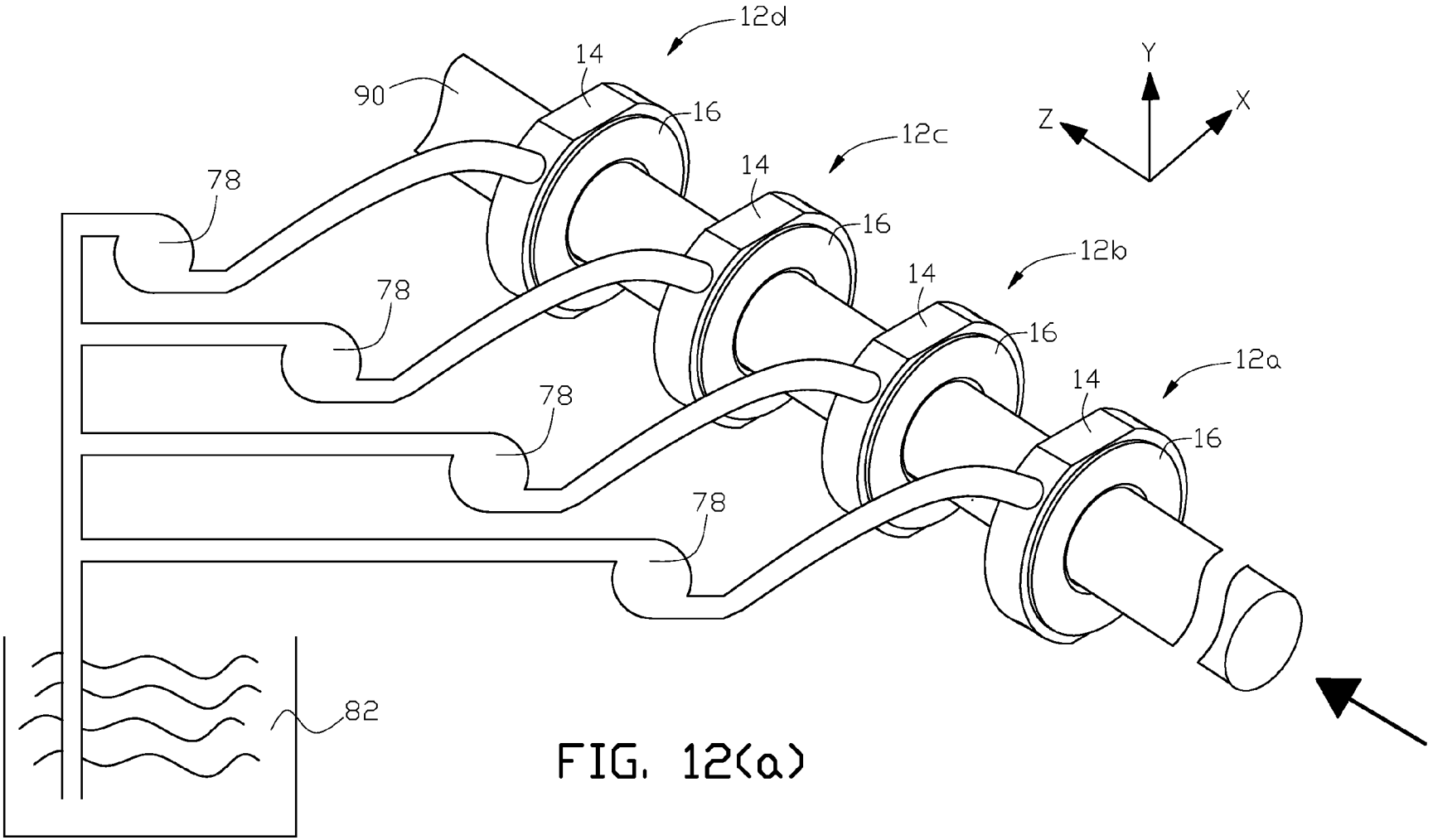
FIG. 12(*a*) illustrates one arrangement for supply of a quenchant to quench rings that can be used in a spray quench system of the present invention.
Figure 12B:
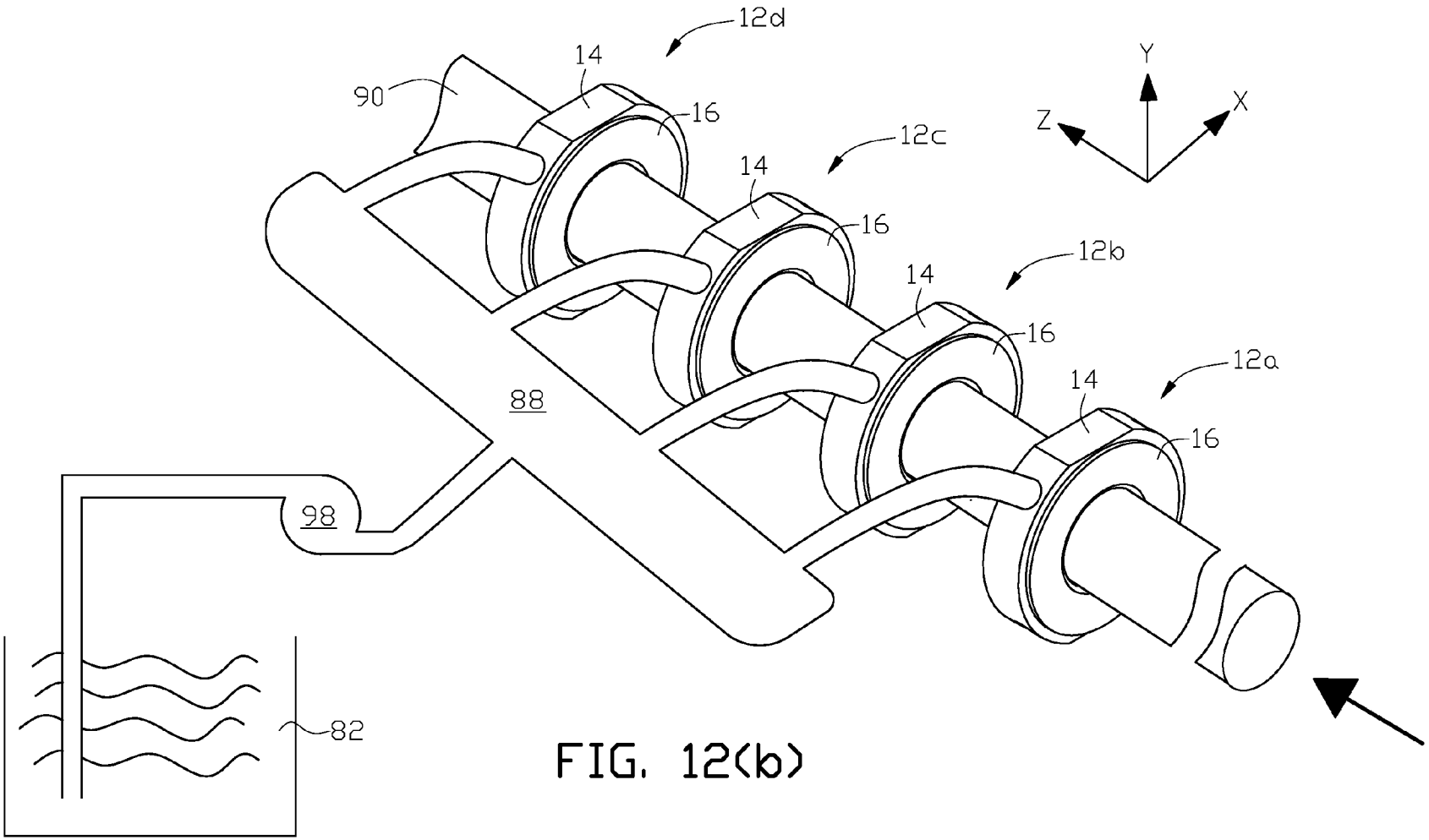
Figure 12C:
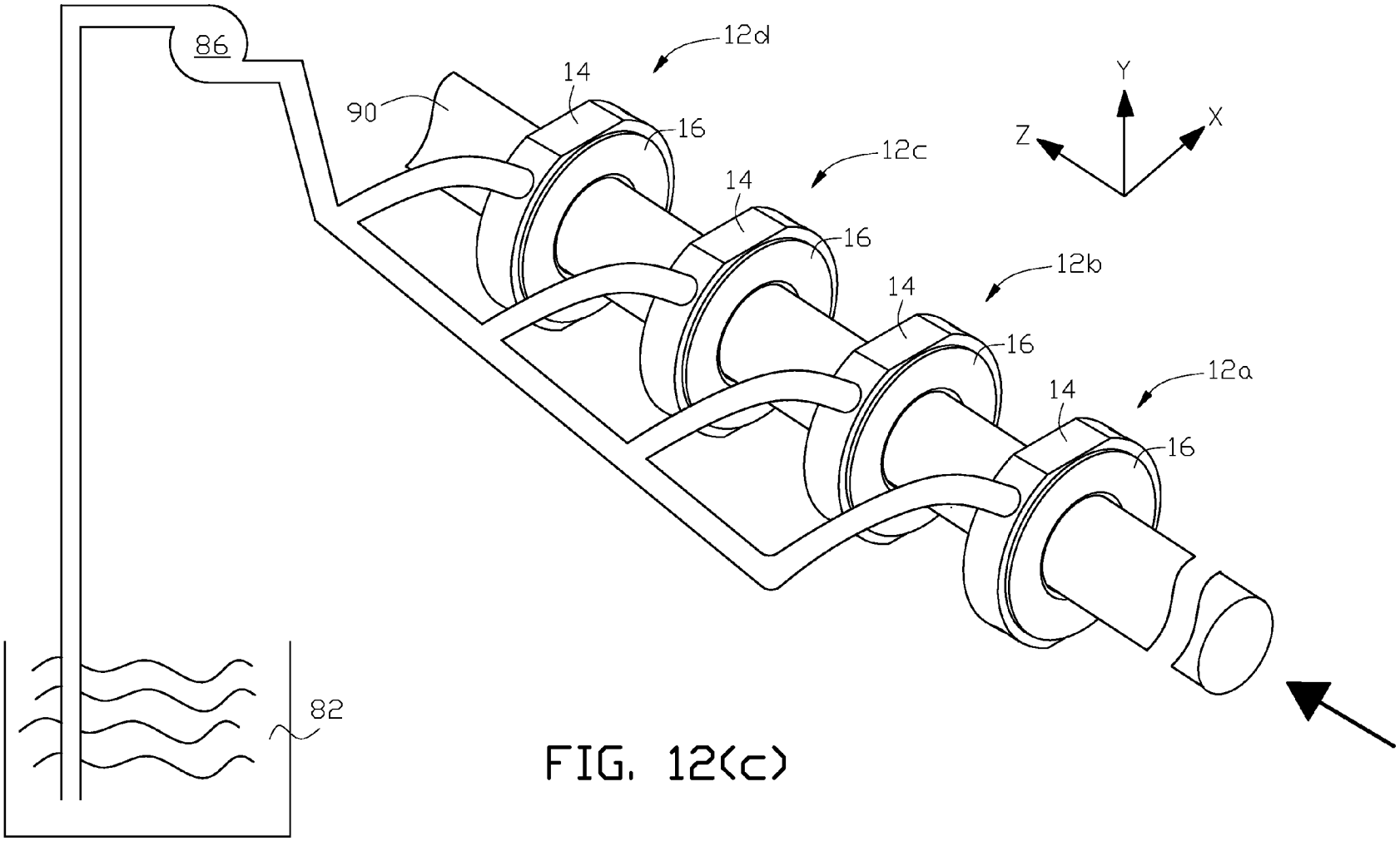

Referring to FIG. 1, there is shown one example of a quench ring 12 used in a spray quench system of the present invention. In this example the quench ring comprises interconnecting first ring element 14 and second ring element 16. In this non-limiting example, second ring element 16 is adjustably inserted into first ring element 14 as best seen in FIG. 3, FIG. 4 or FIG. 5, to form quench ring plenum 18 and outlet passage 20. Moving the first and/or second ring elements along the defined central axis, Zr (FIG. 1), increases or decreases the size of outlet passage 20 of the quench ring to change the pressure, velocity, flow rate and/or pattern of the spray from the outlet passage. In some examples of the invention the outlet passage adjustability can include a closed outlet passage for a zero flow rate. In this non-limiting example of the invention, one or more fasteners 28 are used to control the spacing between the first and second ring elements so that the shape and volume of the outlet opening will correspondingly change as the spacing is changed. Quenchant is supplied to the quench ring plenum by one or more inlet passages 22 from a suitable source. For example as shown in FIG. 12(*a*) to FIG. 12(*c*) quenchant supply can be quenchant reservoir 82 that contains recovered quenchant from previous quench processes by a suitable spent quenchant collection system with makeup quenchant as required. Quenchant is supplied to the inlet passages (also referred to as an exterior opening) of the quench rings by a suitable quenchant supply system as further described below. In this non-limiting example of the invention, outlet passage 20 is an annular opening, generally conical in shape, and ejects quenchant 360 degrees around workpiece 90 in a generally conical volume as illustrated by typical flow volume 92 (partially shown as a shaded section) in FIG. 3, FIG. 4 or FIG. 5. While the present example uses a 360 conical flow pattern, other examples of the invention may use different flow patterns as determined by the particular configurations of first and second ring elements. For example one alternative may be annularly segmented conical flow sections around the workpiece where segmented sections are separated by a barrier to produce quenchant flow in selected one or more regions around the workpiece. For example, as shown for quench ring 15 in FIG. 8(*a*) and FIG. 8(*b*), rather than 360 degrees quenchant flow as described above, quenchant flow 92*a* may be restricted to angular outlet passage regions 20' defined as 0 to 90 degrees and 180 to 270 degrees around the workpiece 90 by separation barriers 20*a* as shown in cross section in FIG. 8(*b*). In some examples of the invention the shape and volume of the outlet of the quench ring may be fixed.

Figure 2:
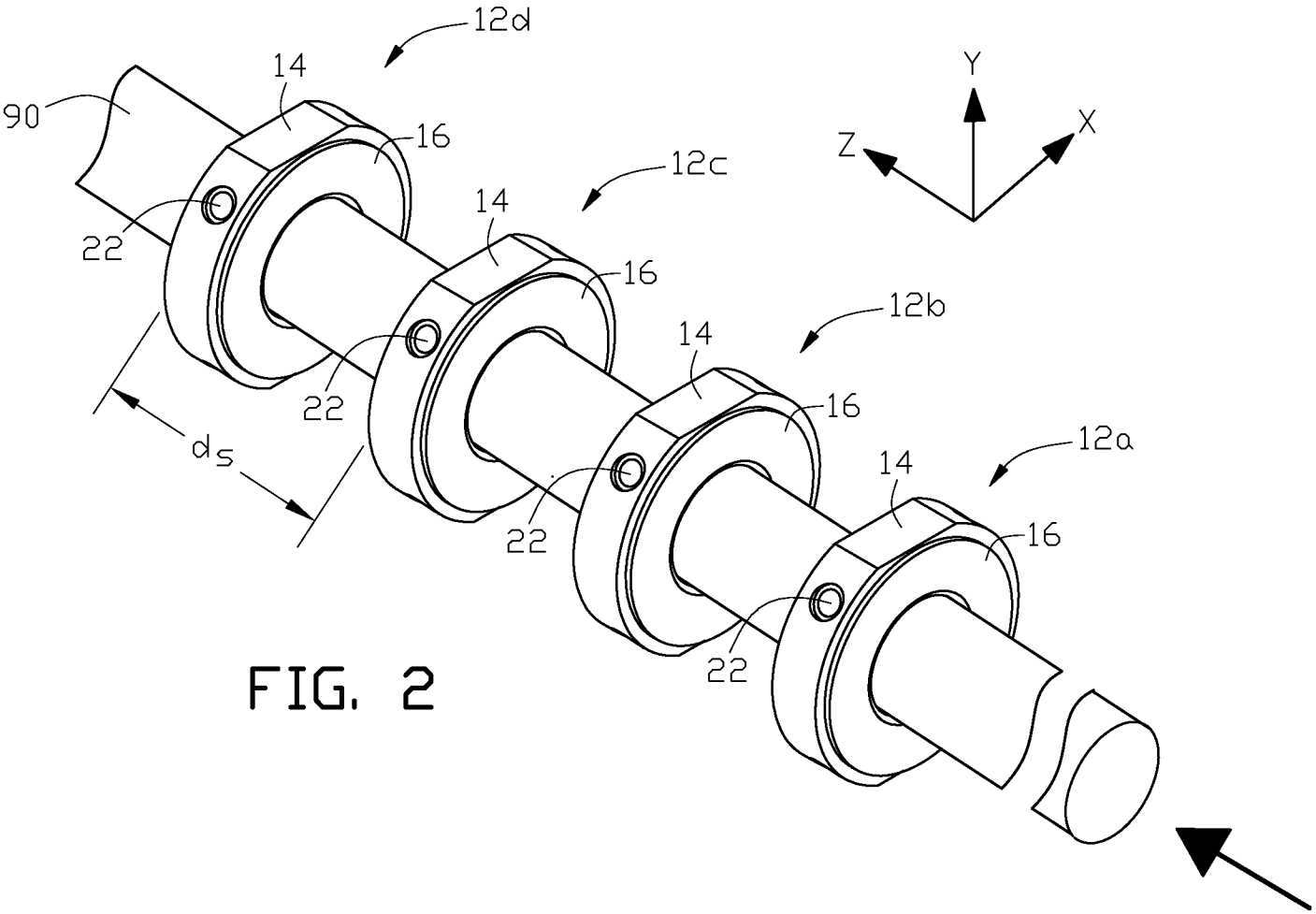
FIG. 2 is a perspective view of one example of a plurality of quench rings used in a spray quench system of the present invention.

FIG. 2 illustrates another example of the spray quench system of the present invention. In this example, a plurality of quench rings 12*a*, 12*b*, 12*c* and 12*d*, surround workpiece 90 as it moves through the quench rings. Each quench ring is similar in construction to the quench ring shown in FIG. 1. The distance, $d_s$, between adjacent quench rings, which can be referred to as the in-line distance, can be independently adjusted by suitable mounting structure to satisfy the quench conditions of a particular application. Further the location of the central axis, $Z_r$, of each quench ring (FIG. 1) may be independently adjusted by suitable mounting structure to satisfy the quench conditions of a particular application. As noted above, in some applications the workpiece rotates about the Z-axis while moving through the one or more quench rings. In this arrangement torque forces may cause the position of the central axis of the workpiece to deviate as it passes through the quench rings. Moving a quench ring so that its central axis tracks this deviation of the position of a workpiece moving through it may be beneficial. For example FIG. 5 illustrates deviation of the central axis of workpiece 90 from being coincidence ($Z_{wp}$) with the central axis, $Z_r$, of the quench rings as it passes through the region of quench ring 12*b* where torque forces cause the central axis of the workpiece to deviate to $Z'_{wp}$. In the present invention quench ring 12*b* can reposition downwards so that its central axis moves towards $Z'_{wp}$ to track the deviation of the central axis of the workpiece.

Figure 7:
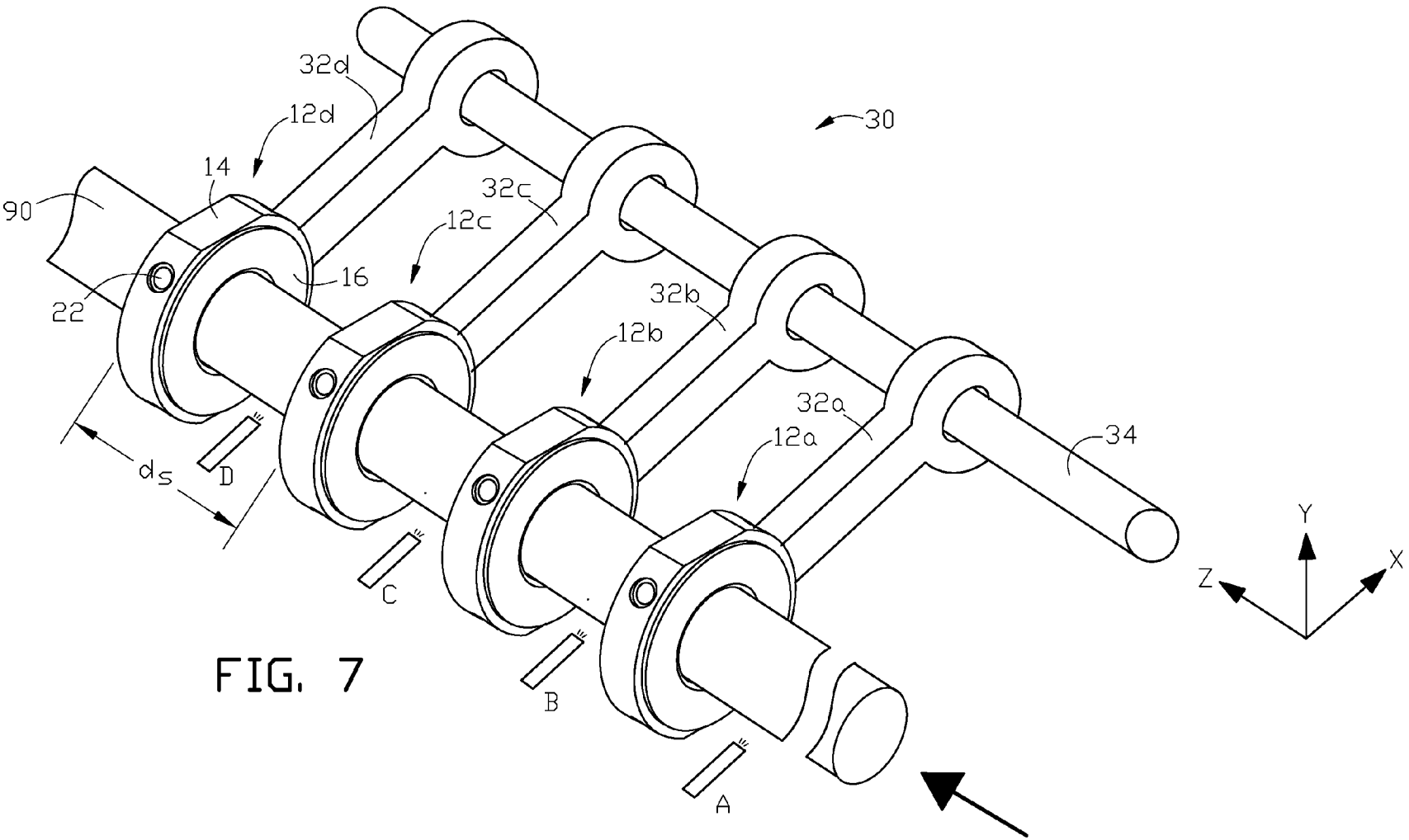
FIG. 7 is a perspective view of one example of a plurality of quench rings in a spray quench system of the present invention wherein the plurality of quench rings are attached to a support structure.

FIG. 7 diagrammatically illustrates one non-limiting example of a suitable mounting support structure 30. Support structure 30 comprises support arms 32*a*-32*d* and quench ring position control element 34. Support arms 32*a*-32*d* connect quench rings 12*a*-12*d*, respectively, to quench ring position control element 34. The position of each support arm can be adjusted along the Z-axis by control element 34 to change the in-line distance, $d_s$, between two or more adjacent quench rings. In some examples of the invention the location of the central axis of one or more of the quench rings can be changed in the X-Y plane by moving the support arm associated with the one or more quench rings in the X-Y plane by control element 34 as shown, for example, by repositioning of quench ring 12*b* in FIG. 5. Control element 34 and the support arms can be driven by suitable actuators that are responsive to the output of a computer process controller (processor) to rapidly perform the desired changes in positions of the one or more quench rings. Changes in position of the one or more quench rings may be accomplished dynamically while the workpiece is being quenched or prior to the beginning of the quench process.

Figure 6:
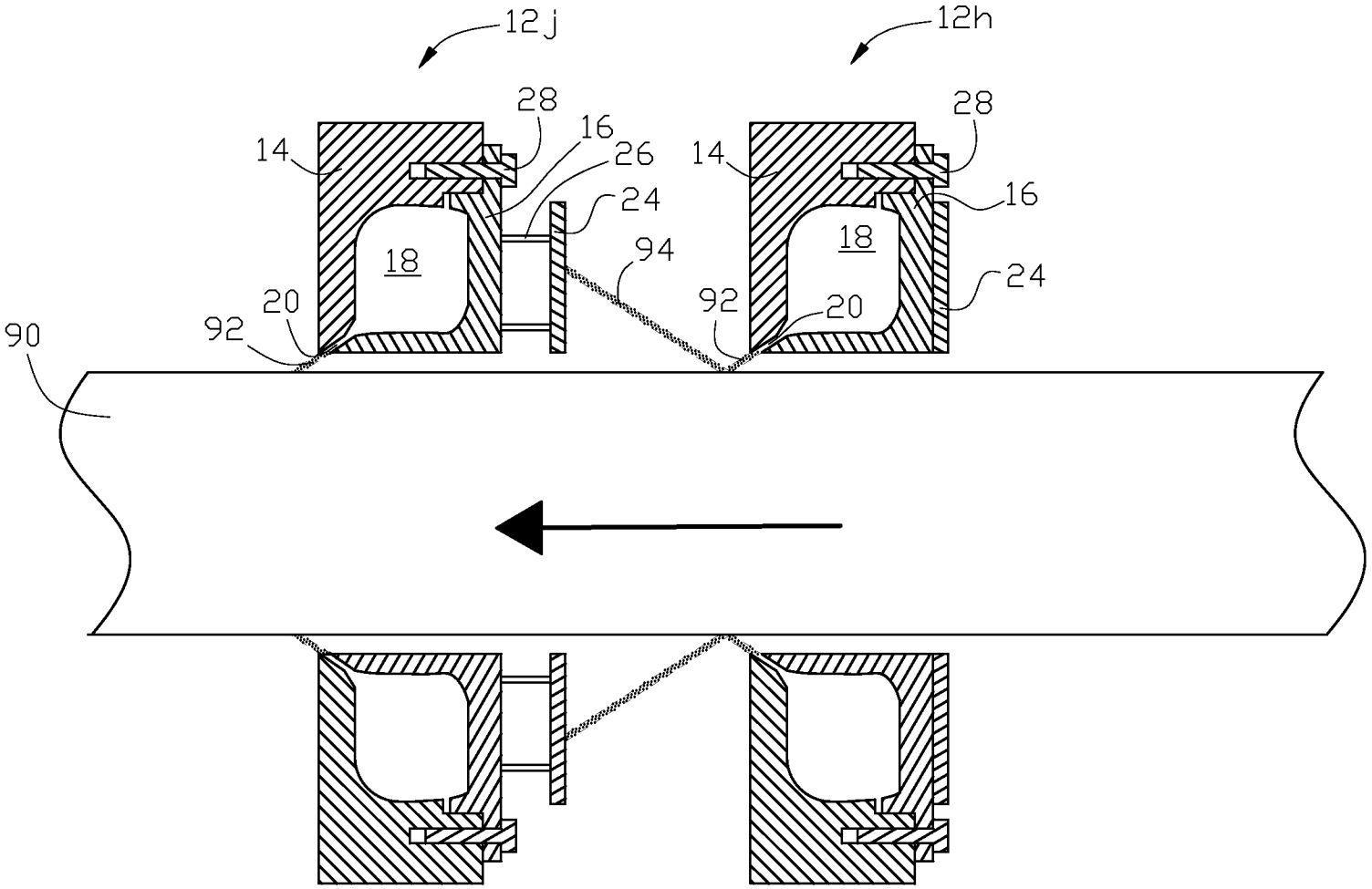
FIG. 6 is a sectional view of one example of two quench rings of a spray quench system of the present invention with one quench ring having an extended spray guard.

FIG. 3 illustrates another example of the spray quench system of the present invention. Quench rings 12*e* and 12*f* are similar in construction to the quench ring shown in FIG. 1, and also include spray guard 24, which is attached to the upstream side of the quench rings to deflect and dissipate reflected spray volume 94 (partially shown as a shaded segment in the figures). One non-limiting example of a spray guard is in the shape of an annular disk. Spray volume 94 represents a typical envelope for spray reflected off of the workpiece from incident spray in volume 92. Deflecting and dissipating the reflected spray volume before quenchant release from a downstream quench ring prevents interference of the reflected spray with the released quenchant from the downstream quench ring. For example in FIG. 4 reflected quenchant released from quench ring 12*e* is deflected by spray guard 24 associated with downstream quench ring 12*f*, and reflected quenchant from quench ring 12*f* is deflected by spray guard 24 associated with downstream quench ring 12*g*. Spray guard 24 may be permanently affixed to a side of its associated quench ring, or adjustably attached to its associated quench ring as shown in FIG. 6, wherein one or more offset fasteners 26 are used to offset spray guard 24 from associated quench ring 12*j*. This arrangement is of advantage in applications where the downstream quench ring is located farther downstream than suitable for mounting a spray guard directly on the side of the quench ring. The shape and positioning of each spray guard can change depending upon a particular arrangement of quench rings and the workpiece being heat-treated.

Figure 13:
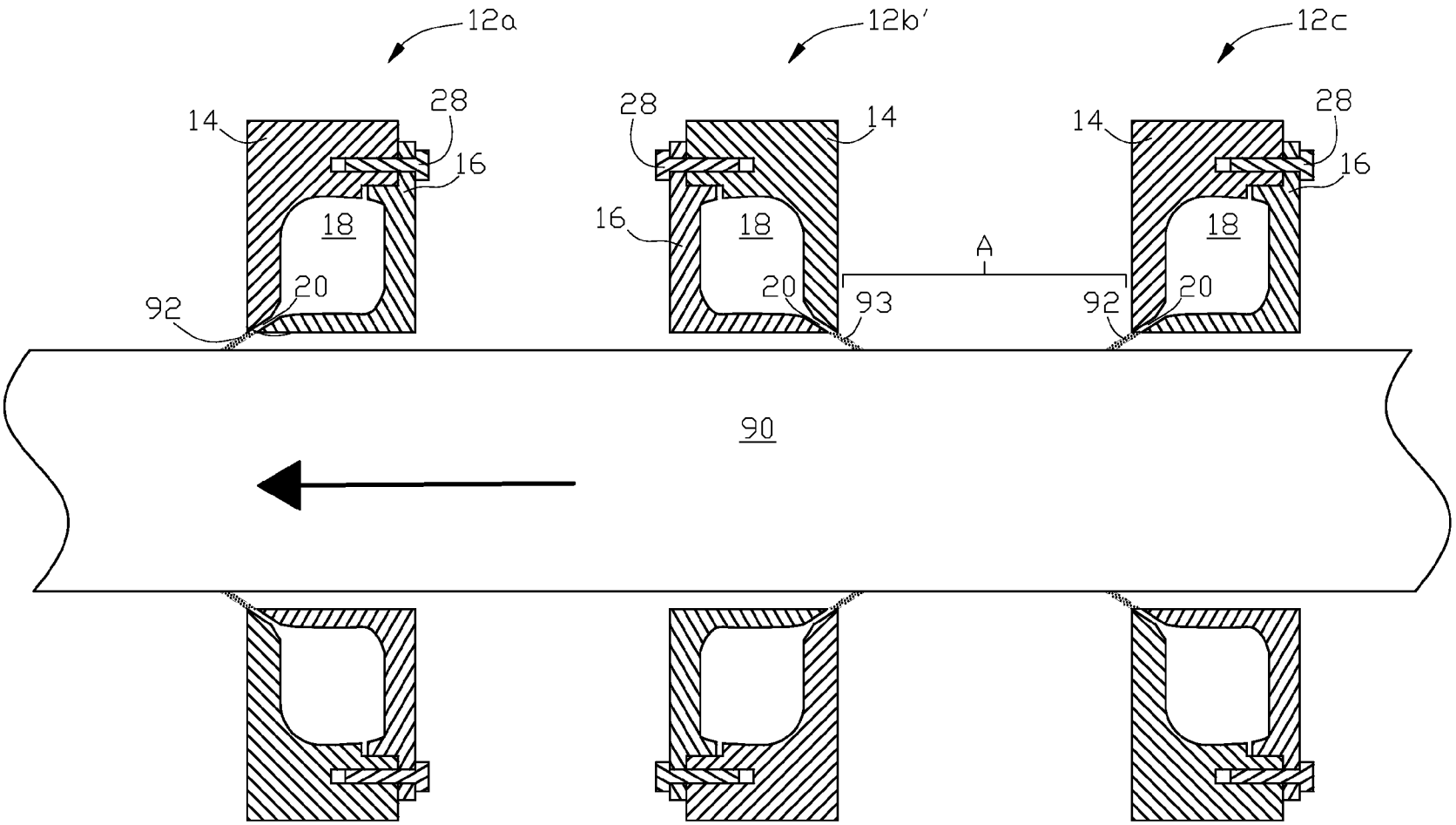
FIG. 13 a sectional view of one example of multiple quench rings for a spray quench system of the present invention with at least one quench ring oriented with an outlet passage on the reverse side of the other quench rings in the system.

In another example of a spray quench system of the present invention as shown in FIG. 13, a plurality of quench rings 12*a*, 12*b'* and 12*c* in this example, can include at least one quench ring 12*b'* where the outlet passage 20 directs a quench flow volume 93 in the upstream direction (opposite to the direction of the workpiece as indicated by the arrow) to provide for focused cooling in a region (region "A" in FIG. 13) in the line of quench rings. The outlet passage 20 of the upstream facing quench ring 12*b'* and the outlet passages 20 of downstream facing quench rings 12*a* and 12*c* can individually transition within a range between a closed (zero flow rate) position to a fully opened (maximum flow rate) position either manually or via a preset program, for example by execution of a spray quench control software program further described below, to execute a quench process. One or more spray guards as described above can be used in region "A" in FIG. 13 to avoid spray interferences as described above.

Figure 9B:
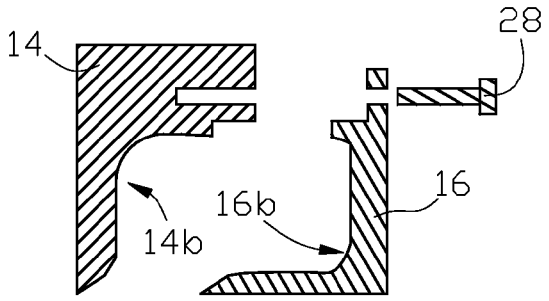
FIG. 9(*a*) is an enlarged cross sectional detail view of one example of an outlet passage of a quench ring that can be used in a spray quench system of the present invention.
Figure 9C:
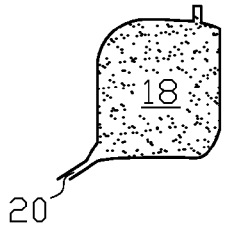
Figure 9A:
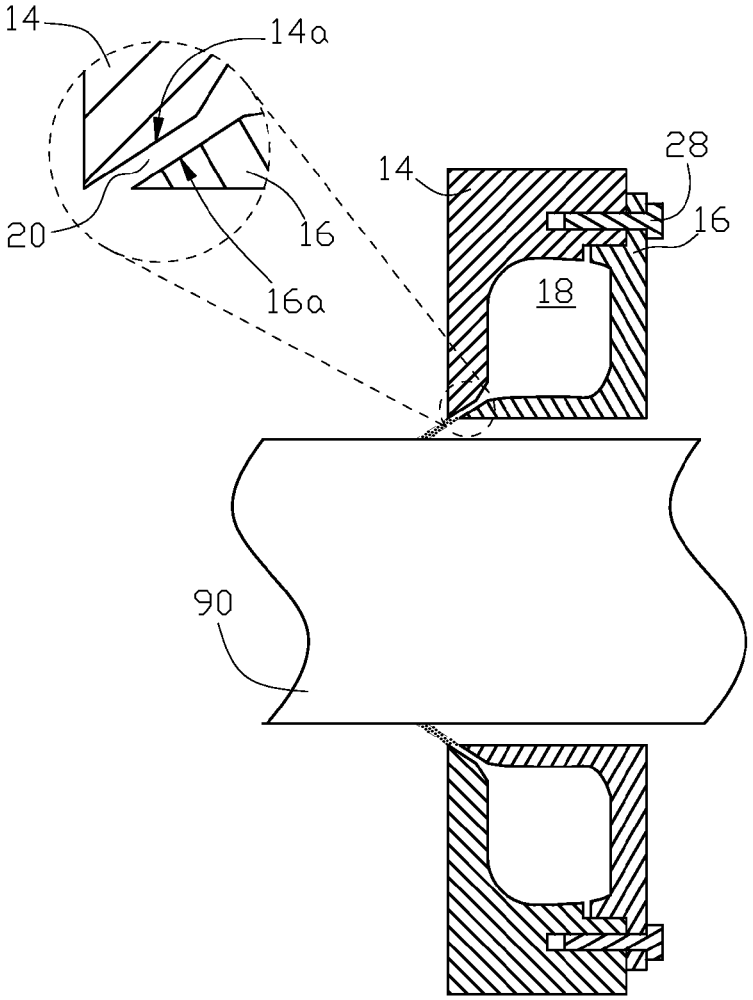

In the above examples of the invention outlet passage 20 of a quench ring used in the spray quench system of the present invention is formed between the facing edge 14*a* of first (outer) ring element 14 and the adjacent facing edge 16*a* of second (inner) ring element 16 as shown in further detail in FIG. 9(*a*) without protrusions of ring elements from the quench ring to achieve the outlet flow volume.

In the above examples of the invention the geometry of the quench ring plenum volume in a quench ring used in a spray quench system of the present invention is determined by the topological inner surfaces of the first (outer) ring element 14 and/or second (inner) ring element 16. In the above examples of the invention, as shown in further detail in FIG. 9(*b*) the topological inner surfaces of the inner and outer ring elements (inner surfaces 16*b* and 14*b* respectively) form an annulus plenum 18 (as shown in cross section in FIG. 9(*c*) that is generally cylindrical in volume with generally rounded corners to minimize turbulent flow of quenchant within the plenum and can have a central axis that is coincident with the axis $Z_r$. Thus, in this example, the portion of the inner ring element partially inserted into the outer ring element is generally tubular in shape. In other examples of the invention the geometry of the inner and outer ring elements may be formed to match specific (non-round) workpiece shapes for products including square, oval, rectangular or complex geometries requiring targeted cooling patterns. The plenum shape can be manipulated by the changes to the inner and outer ring geometries as necessary.

As mentioned above one or more fasteners 28 can be used to control the spacing between the first (inner) and second (outer) ring elements of a quench ring used in a spray quench system of the present invention so that the shape and volume of the outlet opening will correspondingly change as the spacing is changed. In one example of the present invention of a fastener control apparatus the fasteners may be connected to a suitable linear actuator 80 as shown diagrammatically in FIG. 10(*a*) and FIG. 10(*b*) so that the linear actuator linearly moves the fasteners and attached inner ring 16 in the direction of the central axis, $Z_r$, of the quench ring to increase (transition from FIG. 10(*a*) to FIG. 10(*b*)) or decrease (transition from FIG. 10(*b*) to FIG. 10(*a*)) the quenchant flow rate through the outlet passage. FIG. 10(*c*) and FIG. 10(*d*) respectively illustrate in cross section the change in outlet passage and ejected quenchant configurations for the arrangements shown in FIG. 10(*a*) and FIG. 10(*b*). In other examples of the invention the spacing between the inner and outer ring elements can be set manually, for example, by using feeler gages or spacers between inner ring element 14 and outer ring element 16 as the fasteners 28 are adjusted. In a spray quench system of the present invention having a plurality of quench rings, the spacing between the inner and outer ring elements can be adjusted individually for each quench ring. Linear movement between the inner and outer ring elements in direction of the central axis, $Z_r$, results in precision change in the outlet passage compared with a rotational adjustments between quench ring elements.

Figure 11B:
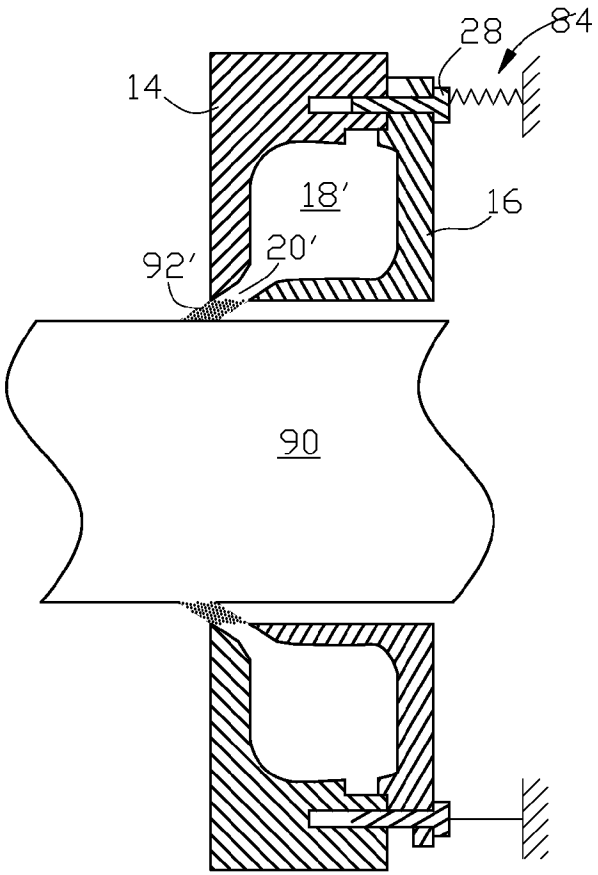
FIG. 11(*a*) and FIG. 11(*b*) illustrate another arrangement for using a fastener control apparatus to change the volume of the outlet passage of a quench ring that can be used in a spray quench system of the present invention.
Figure 11A:
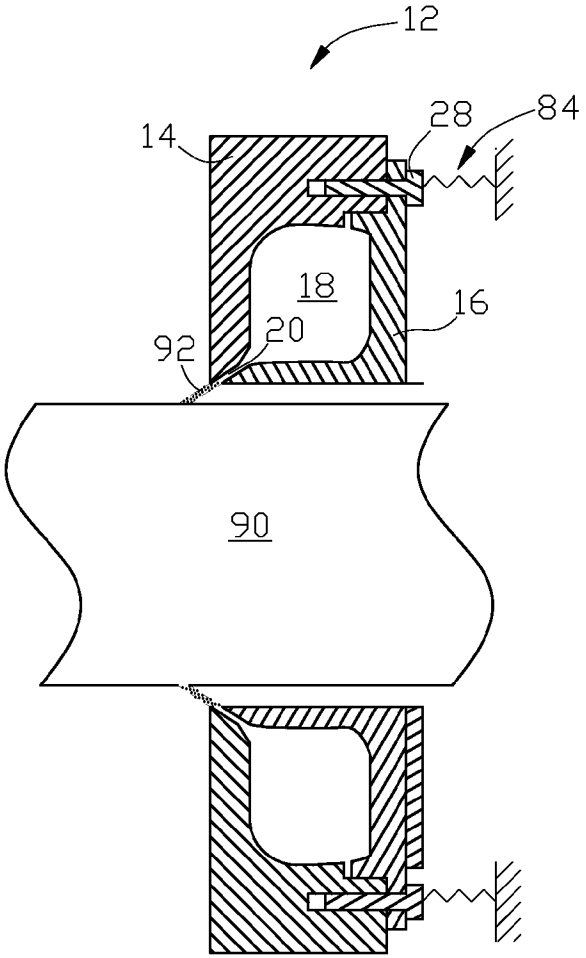

Alternatively in another example of the present invention of a fastener control apparatus the one or more fasteners may be maintained under a tension force, for example by spring 84 as shown in FIG. 11(*a*) so that the pressure of the quenchant supplied to inlet 22 expands the volume of the plenum and compresses spring 84 to increase the quenchant flow rate through outlet passage 20 as shown in FIG. 11(*b*). In other examples of the invention the fasteners may serve to change the volume of the plenum as well as the outlet passage.

In some examples of the invention, as shown in FIG. 12(*a*) a variable displacement pump 78, or other means for controlling a variable flow rate of quenchant to the inlet of one or more quench rings, such as a variable flow control valve, can be used in a spray quench system of the present invention with: (1) the one or more fasteners holding the outlet passage volume fixed; or (2) the one or more fasteners varying the outlet passage volume in combination with the means for controlling a variable flow rate of quenchant to inlet.

In some examples of the invention a quenchant constant displacement pump 98 can be used with a manifold 88 to deliver quenchant to multiple quench rings in a spray quench system of the present invention as shown in FIG. 12(*b*).

In other examples of the invention, as shown in FIG. 12(*c*) a suitable single high pressure pump 86, such as a turbine pump, or other means for supplying quenchant at a uniform flow rate and high pressure can be used to supply quenchant directly to multiple quench rings in a spray quench system of the present invention.

In another example of the invention, in combination with one or more of the above examples of the invention, quenchant flow from individual quench rings in a spray quench system of the present invention can be adjusted to optimize the distribution of the cooling flows from each quench ring to match the overall spray quench system quench rate to the mass cooling requirement of the workpiece. For example a spray quench control system of the present invention may utilize a computer processor with suitable input and output spray quench system control devices to execute a spray quench control software program that may be used to accomplish one or more in combination of at least the following spray quench system adjustments: (1) adjusting the in-line distance between two or more quench rings as further disclosed above; (2) adjusting the central axis of one or more quench rings as further described above; (3) adjusting the position of one or more spray guards as further described above; (4) adjusting the outlet passage shape and volume of one or more quench rings in the spray quench system (including complete closure of the outlet passage for one or more of the quench rings) as further described above; and (5) adjusting the quenchant flow rate and quenchant volume for one or more quench rings by means of a variable displacement pump, or other means for supplying a variable flow volume of quenchant to one or more of the quench rings. These quench system adjustments may be dynamically accomplished by a computer program executed by the computer processor based upon the mass cooling requirements of the workpiece passing through the quench rings that may be determined, for example, by trial and error quench sample processing. In some examples of the invention heat imaging of the workpiece passing through the spray quench system of the present invention, for example by infrared sensing and imaging, may be used to provide feedback data to the spray quench control system to indicate real time cooling results via infrared sensors A through D shown in FIG. 7 to adaptively perform one or more of the five spray quench system adjustments described above.

In another example of the invention, one or more quench rings of a particular inside diameter can be assembled in a module for a spray quench system of the present invention. The module can incorporate the support structure described above. Different modules having quench rings of different inside diameters, and/or other different quench system features, may be interchanged on a heat treatment line to accommodate workpieces of different dimensions and/or workpieces having different mass cooling requirements. Quick connections for quenchant and any electrical and/or mechanical interfaces may be provided with each module.

The particular shape of the first and second quench ring elements shown in the examples of the invention may be changed without deviating from the scope of the invention as long as the elements form a quenchant plenum chamber and adjustable outlet opening or openings. Further, more than two ring elements (first and second quench ring elements) may perform the same functions of the described invention without deviating from the scope of the invention. In some examples of the invention the one or more quench rings may be formed as a split ring assembly, with optional hinge elements, so that the one or more quench rings may be interchanged around a workpiece.

Figure 14:
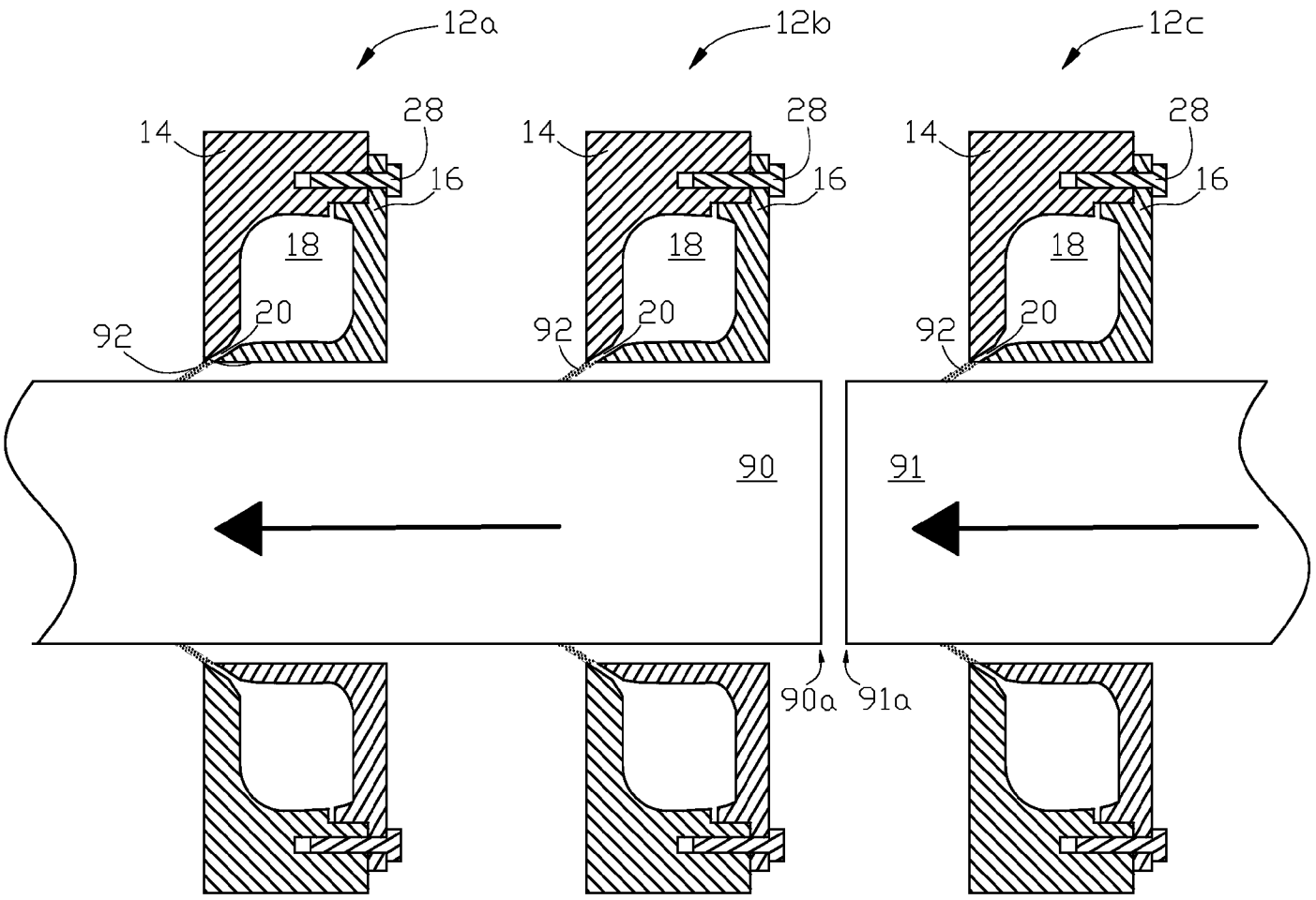
FIG. 14 illustrates in cross section consecutively feeding the opposing ends of two discrete workpieces through a spray quench system of the present invention.

The spray quench systems of the present invention are a particular improvement over various prior art systems in that the established flow volume 92 from the quench rings as shown, for example, in FIG. 14 avoids or minimizes end-of-workpiece undesirable end-quench effects and entry of quenchant into the end interior regions of adjoining workpieces 90 and 91. While the end-to-end distance between sequential workpieces passing through a spray quench system is typically based on other process requirements, facing trailing end 90*a* of workpiece 90 and leading end 91*a* of workpiece 91 can include up to zero end-to-end distance (that is pipe trailing end 90*a* and leading end 91*a* in contact with each other) without end-quench effects and no entry of quenchant into the interior of the workpieces.

While a certain number of quench rings are shown in the various examples of the invention, the number of quench rings may be changed without deviating from the scope of the invention. Further, one or more quench rings may be interspaced with other components in a particular application, such as mechanical supports or transport components for the workpiece, and heating components, such as induction heating devices. In arrangements with two or more quench rings, the outlet volume of each quench ring may be independently adjusted to form a unique spray volume as required for a particular application.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification and the appended claims, may effect numerous modifications thereto, and changes may be made without departing from the scope of the invention in its aspects.

The invention claimed is:

1. A spray quench system for quenching a workpiece, the spray quench system comprising:

a supply of a quenchant to one or more quench rings, each of the one or more quench rings comprising:

an outer ring element having at least one exterior opening for connection to the supply of the quenchant to an interior region of the outer ring element;

an inner ring element at least partially inserted into the outer ring element;

a quench ring plenum formed from the interior region of the outer ring element in combination with an interior region of the inner ring element for receiving the supply of the quenchant from the at least one exterior opening;

an outlet passage from the quench ring plenum formed between an adjacent facing edges of the outer ring element and the inner ring element for receiving the quenchant from the quench ring plenum and ejecting the quenchant received from the quench ring plenum in a conical volume to make contact with a surface region of the workpiece; and one or more fasteners joining the inner ring element and the outer ring element.

2. The spray quench system of claim 1 further comprising a fastener control apparatus to dynamically adjust the one or more fasteners for at least one of the one or more quench rings to change the conical volume of the outlet passage.

3. The spray quench system of claim 2 wherein the supply of the quenchant to the one or more quench rings comprises a fixed displacement pump supplying the quenchant from a quenchant reservoir to a quenchant manifold having a plurality of quenchant manifold outlets, each of the plurality of quenchant manifold outlets connected exclusively to the at least one exterior opening of one of the one or more quench rings.

4. The spray quench system of claim 2 wherein the supply of the quenchant to the one or more quench rings comprises a uniform flow, high pressure pump supplying the quenchant from a quenchant reservoir to each of the at least one exterior opening of each of the one or more quench rings.

5. The spray quench system of claim 1 wherein the supply of the quenchant comprises a means for variably controlling a flow rate of the quenchant from a quenchant reservoir to each of the one or more quench rings to dynamically adjust a mass flow rate of the quenchant through the quench ring plenum and the outlet passage and a quenchant velocity of the quenchant ejected from the outlet passage.

6. The spray quench system of claim 5 wherein the means for variably controlling the flow rate of the quenchant from the quenchant reservoir comprises one or more variable displacement pumps, each of the one or more variable displacement pumps supplying the quenchant to one or more of the at least one or more quench rings.

7. The spray quench system of claim 6 further comprising a fastener control apparatus to dynamically adjust the one or more fasteners for at least one of the one or more quench rings to change the volume of the outlet passage of the at least one of the one or more quench rings.

8. A method of quenching a workpiece with a spray quench system, the method comprising:

passing the workpiece through a quench ring assembly comprising one or more quench rings, each of the one or more quench rings having an outer ring element at least partially inserted into an inner ring element, and the outer ring element and the inner ring element joined together by one or more fasteners, the outer ring element having at least one exterior opening to an interior region of the outer ring element;

supplying a quenchant to the at least one exterior opening of each one of the one or more quench rings, the at least one exterior opening in communication with a quench ring plenum formed from the interior region of the outer ring element in combination with an interior region of the inner ring element for receiving the quenchant from the at least one exterior opening, the quench ring plenum in communication with an outlet passage from the quench ring plenum formed between an adjacent facing edges of the outer ring element and the inner ring element for receiving the quenchant from the quench ring plenum; and ejecting the quenchant from the output passage of each of the one or more quench rings in a conical volume to make contact with a surface of the workpiece.

9. The method of claim 8 wherein the one or more quench rings comprises at least two quench rings and the step of ejecting the quenchant from the outlet passage of each of the at least two quench rings further comprises ejecting the quenchant from at least one of the at least two quench rings in an upstream direction opposite the direction of the workpiece passing through the quench ring assembly and ejecting the quenchant from the remainder of the at least two quench rings in a downstream direction corresponding to the direction of the workpiece passing through the quench ring assembly.

10. The method of claim 8 further comprising dynamically adjusting a mass flow rate of the quenchant through the quench ring plenum and the outlet passage, and dynamically adjusting a quenchant velocity of the quenchant ejected from the outlet passage by supplying the quenchant to the at least one exterior opening of each one of the one or more quench rings at a variably controlled flow rate.

11. The method of claim 10 further comprising dynamically controlling the one or more fasteners joining the inner ring element and the outer ring element to change the conical volume of the outlet passage.

12. The method of claim 8 further wherein supplying the quenchant to the at least one exterior opening of each one of the one or more quench rings further comprises supplying the quenchant from a quenchant manifold having one or more manifold outlets, each one of the plurality of manifold outlets connected exclusively to the at least one exterior opening of each one of the one or more quench rings, the method further comprising:

supplying the quenchant to the quenchant manifold from a fixed displacement pump; and dynamically controlling the one or more fasteners joining the inner ring element and the outer ring element to change the conical volume of the outlet passage.

13. The method of claim 8 further wherein supplying the quenchant to the at least one exterior opening of each one of the one or more quench rings further comprises supplying the quenchant from a uniform flow, high pressure pump, the method further comprising dynamically controlling the one or more fasteners joining the inner ring element and the outer ring element to change the conical volume of the outlet passage.

14. The method of claim 8 further comprising sequentially passing a second workpiece through the quench ring assembly with a leading end of the second workpiece adjacent to a trailing end of the workpiece.

15. A method of quenching a workpiece with a spray quench system, the method comprising:

passing the workpiece through a quench ring assembly comprising one or more quench rings, each of the one or more quench rings having an outer ring element at least partially inserted into an inner ring element, and the outer ring element and the inner ring element joined together by one or more fasteners, the outer ring element having at least one exterior opening to an interior region of the outer ring element;

a quench ring plenum formed from the interior region of the outer ring element in combination with an interior region of the inner ring element for receiving a quenchant from the at least one exterior opening; an outlet passage from the quench ring plenum formed between an adjacent facing edges of the outer ring element and the inner ring element for receiving the quenchant from the quench ring plenum and ejecting the quenchant received from the quench ring plenum in a conical volume to make contact with a surface region of the workpiece;

supplying a quenchant from at least one variable displacement pump, a single uniform flow, high pressure pump or a quenchant manifold supplied with quenchant from a fixed displacement pump to the at least one exterior opening of each one of the one or more quench rings, the at least one exterior opening in communication with a quench ring plenum formed from the interior region of the outer ring element in combination with an interior region of the inner ring element for receiving the quenchant from the at least one exterior opening, the quench ring plenum in communication with an outlet passage from the quench ring plenum formed between an adjacent facing edges of the outer ring element and the inner ring element for receiving the quenchant from the quench ring plenum; and ejecting the quenchant from the output passage of each of the one or more quench rings in a conical volume to make contact with a surface of the workpiece.

16. The method of claim 15 further comprising dynamically controlling the one or more fasteners joining the inner ring element and the outer ring element to change the conical volume of the outlet passage.

17. The method of claim 15 wherein the one or more quench rings comprises at least two quench rings, the method further comprising the step of dynamically adjusting the in-line distance between at least two adjacent quench rings of the at least two quench rings responsive to a mass cooling requirement of the workpiece passing through the quench ring assembly.

18. The method of claim 15 further comprising the step of dynamically adjusting the location of a central axis of at least one quench ring of the one or more quench rings responsive to the location of a central axis of the workpiece passing through the one or more quench rings.

19. The method of claim 15 wherein the one or more quench rings comprises at least two quench rings, further comprising the step of dynamically adjusting the location of a spray guard positioned external to either the inner ring element or the outer ring element of at least one of the two quench rings to deflect a reflected spray from the workpiece resulting from the quenchant ejected from the outlet passage of one of the at least two quench rings adjacent to the spray guard responsive to a mass cooling requirement of the workpiece passing through the quench ring assembly.

20. The method of claim 15 wherein the one or more quench rings comprises at least two quench rings, the method further comprising a computer processor executing a spray quench control software program to coordinate the quenchant ejected from each of the at least two quench rings with a mass cooling requirement of the workpiece as the workpiece passes through the spray quench system by selectively or in combination:

(1) adjusting an in-line distance between at least two of the at least two quench rings;

(2) adjusting the location of a central axis of at least one of the at least two quench rings;

(3) adjusting the position of at least one spray guard associated with at least one of the at least two quench rings;

(4) adjusting the conical volume of the outlet passage of at least one of the at least two quench rings; and (5) adjusting a mass flow rate of the quenchant and a quenchant velocity for at least one of the at least two quench rings.

21. The method of claim 20 further comprising the step of sensing the temperature of the workpiece as the workpiece passes through the quench ring assembly to coordinate the quenchant ejected from each of the at least two quench rings with the mass cooling requirement of the workpiece as the workpiece passes through the quench ring assembly.

* * * * *